US006499174B2

(12) United States Patent
Henrie

(10) Patent No.: US 6,499,174 B2
(45) Date of Patent: Dec. 31, 2002

(54) CLEANING BRUSH HAVING BACK-TO-BACK PLANAR AND CONCAVE HEADS

(76) Inventor: James L. Henrie, 746 E. 100 North, Orem, UT (US) 84097

( * ) Notice: Subject to any disclaimer, the term of this patent is extended or adjusted under 35 U.S.C. 154(b) by 39 days.

(21) Appl. No.: 09/800,623

(22) Filed: Mar. 6, 2001

(65) Prior Publication Data

US 2002/0124336 A1 Sep. 12, 2002

(51) Int. Cl.[7] ..... A46B 9/02
(52) U.S. Cl. ..... 15/106; D4/119; D4/127
(58) Field of Search ..... 15/106, 159.1, 15/160, 207.2, DIG. 6; D4/105, 111, 119, 127, 130, 132, 134

(56) References Cited

U.S. PATENT DOCUMENTS

| | | | | |
|---|---|---|---|---|
| 106,680 | A | * | 8/1870 | Firey |
| D104,029 | S | * | 4/1937 | Gray |
| D114,197 | S | * | 4/1939 | Muller-Munk |
| 2,241,584 | A | * | 5/1941 | Cohen |
| 2,633,591 | A | * | 4/1953 | Servilla |
| 3,748,681 | A | * | 7/1973 | Morris |
| 3,765,046 | A | * | 10/1973 | Tsuruzawa |
| D235,592 | S | * | 7/1975 | Kirk |
| D250,229 | S | * | 11/1978 | Werner |
| 4,150,457 | A | * | 4/1979 | Larson |
| D346,698 | S | * | 5/1994 | Hinnant |
| D369,906 | S | * | 5/1996 | Henrie |
| 5,544,383 | A | * | 8/1996 | Gamble |
| 5,655,249 | A | | 8/1997 | Li |
| 5,860,432 | A | * | 1/1999 | Gueret |

FOREIGN PATENT DOCUMENTS

| | | | |
|---|---|---|---|
| JP | 2000-325146 | * | 11/2000 |

* cited by examiner

*Primary Examiner*—Terrence R. Till
(74) *Attorney, Agent, or Firm*—Angus C. Fox, III

(57) ABSTRACT

A cleaning brush suitable for use in connection with automotive cleaning tasks, incorporates back-to-back bristle heads at one end of an elongated handle. One of the bristle heads features a concave, or dished, face; the other bristle head has a planar face. The concave brush head is intended for use on tires, and as such, is fabricated from fewer, coarser bristles than is the planar brush head, which is intended for use on wheels and body parts. For a preferred embodiment of the invention, the handle is about 61 cm (24 inches) in length, and includes an elongated portion of square cross section and a flattened, largely disk-shaped portion in which bristles of both heads are imbedded. Optionally, the handle at the end opposite the disk-shaped portion includes an aperture which may be used to hand the brush on a hook.

17 Claims, 2 Drawing Sheets

CLEANING BRUSH HAVING BACK-TO-BACK PLANAR AND CONCAVE HEADS

BACKGROUND OF THE INVENTION

1. Field of the Invention

The present invention relates to brushes uses for cleaning and scrubbing tasks and, more particularly, to brushes used for certain automotive cleaning tasks.

2. Description of the Prior Art

Brushes are essential equipment for many cleaning operations. This is particularly true of automotive cleaning operations, where a variety of brushes are utilized for the various tasks involved in cleaning a vehicle. Automatic vehicle cleaning equipment generally utilizes specialized brushes for cleaning certain vehicle components, such as tires, which have high resistance to abrasion and scratching. Painted surfaces are much more delicate and must be treated with greater care to avoid damage from scratching and abrasion during cleaning. Harsh cleaning compounds and coarse brushes can rapidly abrade painted finishes. Even polishing operations, which are often used to restore the luster of certain easily oxidized paints, can completely erode the color coat in less than a dozen such operations.

It is generally acknowledged within the automotive paint products industry that directives promulgated by the Environmental Protection Agency (EPA) have had a deleterious effect on the quality of automotive finishes. Within the past decade or so, they have become generally less durable and more susceptible to damage from the sun and the elements. In an effort to reduce the amounts of solvents that were being introduced into the atmosphere, automobile manufactures began to use water-based primer paints somewhat more than a decade ago with what could be fairly characterized as disastrous results. Because of the relative inferiority of modern automotive paints, not only is it essential that automobiles be keep clean on a regular basis in order to remove damaging chemicals from the painted surfaces, it is also important to treat those surfaces with particular care to avoid mechanical damage from the cleaning process. Because of these factors, modern automotive cleaning equipment should be tailored to the task.

Despite the existence of automatic car wash equipment in most major metropolitan areas, some individuals still insist on manually washing their vehicles. In addition, there are many smaller towns which will probably never have the luxury of an automatic car wash. Consequently, there will always be a need for manual car washing equipment, such as specialized brushes, chamoises, and the like.

U.S. Pat. No. D 369,906 to Jim Henrie discloses a cleaning brush for tires having a face of bristles with an inner cylindrical profile. The bristles generally conform to the profile of a tire sidewall so that they may be more evenly and quickly cleaned. Although relatively effective, use of the brush requires that the user kneel or stoop to the level of the tire. Another scrub brush having a curved bristle face is shown in U.S. Pat. No. D 235,592.

What is needed is a multi-purpose scrub brush optimized for certain manual automotive cleaning tasks, including the cleaning of tires, which does not require the user to kneel or stoop to perform the task.

SUMMARY OF THE INVENTION

A cleaning brush suitable for use in connection with automotive cleaning tasks, incorporates back-to-back bristle heads at one end of an elongated handle. One of the bristle heads features a concave, or dished, face; the other bristle head has a planar face. The concave brush head is intended for use on tires, and as such, is fabricated from fewer, coarser bristles than is the planar brush head, which is intended for use on wheels and painted body parts. The free ends of the bristles of the planar head may be abraded or frayed to increase their softness and reduce their abrasiveness. For a preferred embodiment of the invention, the handle is about 61 cm (24 inches) in length, and includes an elongated portion of square cross section. The handle is rigidly attached to a flattened, largely disk-shaped back in which bristles of both heads are imbedded. Optionally, the handle at the end opposite the disk-shaped back includes an aperture which may be used to hand the brush on a hook. For a preferred embodiment of the invention, the handle and back are injection molded as a single unit from structural polymeric plastic material, such as nylon, polyester, acrylic, polycarbonate, or polystyrene. The plastic material may incorporate strength-enhancing glass or carbon fibers. The bristles for both brush heads are preferably made from a polymeric material such as nylon, polyester, or polypropylene, although the use of natural bristles is also contemplated.

PREFERRED EMBODIMENT OF THE INVENTION

The present invention is a back-to-back cleaning brush that has been optimized for certain manual cleaning of automobiles, sport utility vehicles and trucks. It will now be described with reference to the attached drawing FIGS. 1 through 7.

Figure 1:
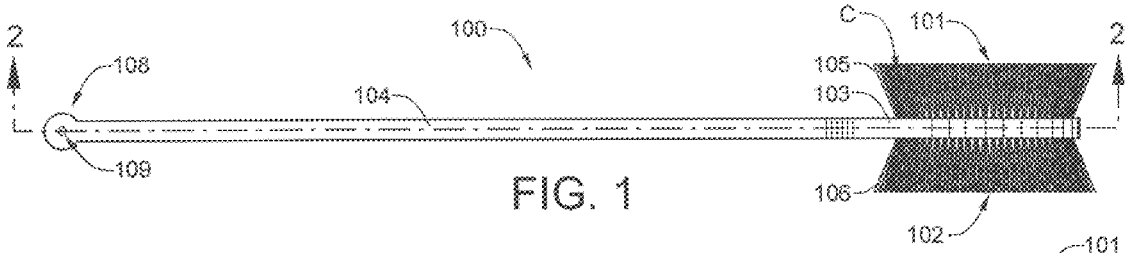
FIG. 1 is a right side elevational view of the back-to-back brush, the left side elevational view being a mirror image thereof.

Referring now to FIG. 1, a back-to-back cleaning brush 100 suitable for use in connection with certain manual automotive cleaning tasks, incorporates a pair of back-to-back brush heads 101 and 102 on opposite sides of a generally circular disk-shaped back, or body 103 that is unitary with and at one end of an elongated handle 104. The first brush head 101 features a concave, or dished, face (not visible in this view). The curved line C represents the unseen concave profile of the first brush head 101, taken through the center thereof. The second brush head 102 has a planar face. The concave brush head 101 is intended for use on tires, while the planar brush head 102 is intended for use on wheels and painted body parts. The bristles 105 of the concave head 101 are coarser and fewer in number than the bristles 106 of the planar head. An optimum diameter for bristles of the concave head 101 is deemed to be 0.015–0.020 inch (about 0.4–0.5 mm). For the planar head, bristle diameters of approximately half the diameter of those used for the concave head 101 are deemed to be optimum for those of the planar head 102. The free ends of the bristles of the planar head 102 may be abraded or frayed to increase their softness and reduce their abrasiveness. For a preferred embodiment of the invention, the handle and body are, together, about 61 cm (24 inches) in length. The handle 104 is of generally rectangular or square cross section, and may be fitted with an optional plastic or rubber grip 107. The free end 108 of the handle 104 incorporates an aperture 109 from which the cleaning brush 100 may be hung on a hook embedded in a vertical surface or wall so that the brush faces are generally perpendicular to the vertical surface.

Figure 2:
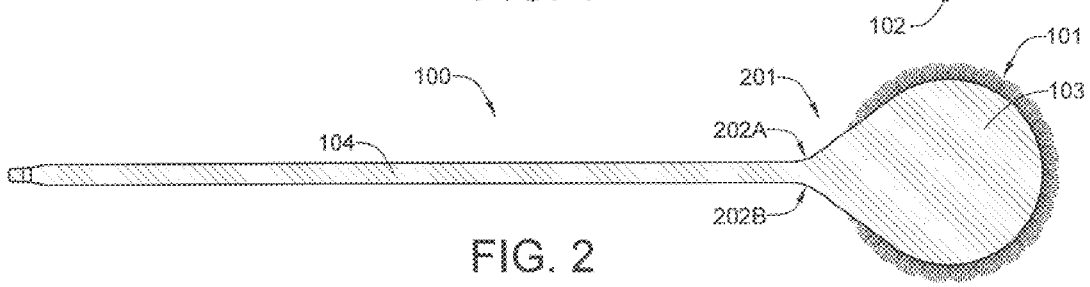
FIG. 2 is a cross-sectional view of the back-to-back brush of FIG. 1, taken through line 2—2 thereof.
Figure 3:
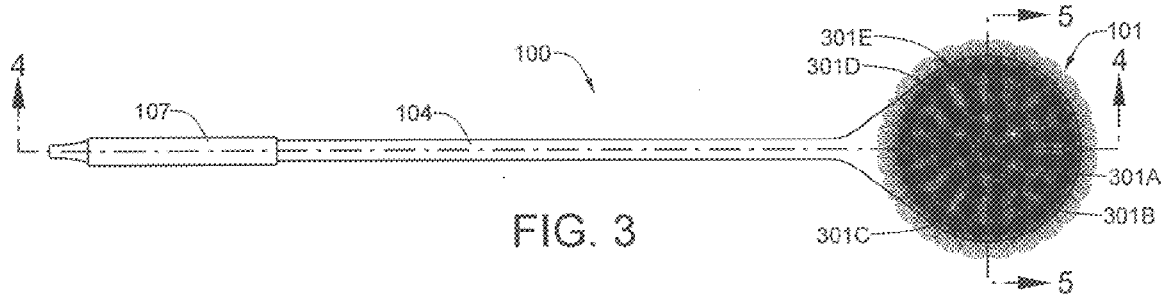
FIG. 3 is a top plan view of the back-to back brush of FIG. 1, the bottom plan view being indistinguishable other than the coarseness and number of bristles in each bristle bundle and the planar face presented by all bristle bundles.

Referring now to FIGS. 2 and 3, it will be noted that the bristle patterns of both heads 101 and 102 of the back-to-back cleaning brush 100 are generally circular in shape. In order to reduce mechanical stresses at the junction region 201 of the body 103 and the handle 104, the generally circular disk-shaped body incorporates fillets 202A and 202B between the body 103 and the handle 104. In FIG. 3, it will be noted that the bristles are arranged in bristle bundles 301 which are arranged as a center bundle 301A and 57 additional bristle bundles arranged in 4 concentric circular patterns of bristle bundles 301B, 301C, 301D and 301E.

Figure 4:
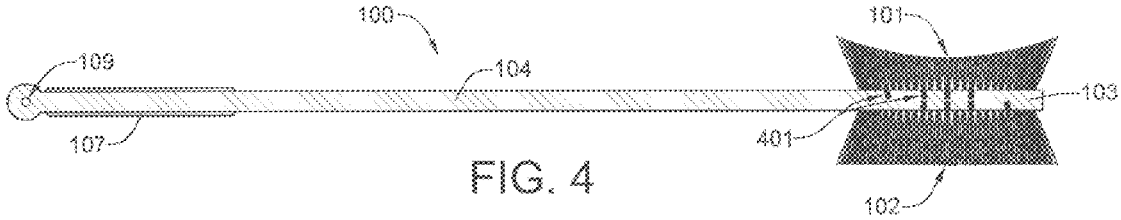
FIG. 4 is a cross-sectional view of the back-to-back brush of FIG. 3, taken through line 4—4 thereof, showing a first embodiment bristle configuration for the concave brush head.
Figure 5:
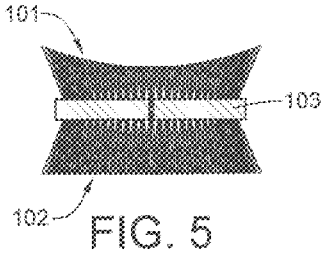
FIG. 5 is a cross-sectional view of the back-to-back brush of FIG. 3, taken through line 5—5 thereof.

Referring now to the cross-sectional views of FIGS. 4 and 5, a brief explanation is in order. Because of the difficulty involved in showing the concave nature of brush head 101 in a true cross-sectional view, the views of FIGS. 4 and 5 are better characterized as a thin slice view through the center of the head 103 and handle 104. By thin slice is meant a slice having a thickness that is approximately one to two bristle bundles 301 in thickness. It will be noted that each bristle bundle 301 is imbedded within a cavity 401 within the body 103. The body 103 and handle 104 are preferably made from durable polymeric plastic material, and may be reinforced with structural glass or carbon fibers. Suitable polymeric plastic materials are deemed to be polyester, polystyrene, acrylic, polycarbonate, epoxy resins, nylon, and other similar materials. Though not preferred because of its propensity to swell when submersed in water and to crack when drying out, wood may be used for the body 103 and handle 104. The bristles for both brush heads may be made from a polymeric material such as nylon, polyester, or polypropylene. Though not preferred, natural fibers may also be used for both brush heads.

Figure 6:
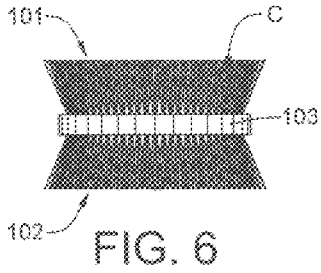
FIG. 6 is a front elevational view of the back-to-back brush.
Figure 7:
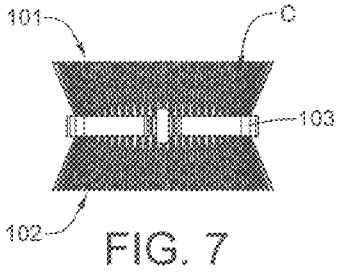
FIG. 7 is a rear elevational view of the back-to-back brush.

Referring now to FIGS. 6 and 7, the front and end views are self explanatory and provide additional detail relating to the shape of the preferred embodiment of the new back-to-back cleaning brush 100.

Figure 8:
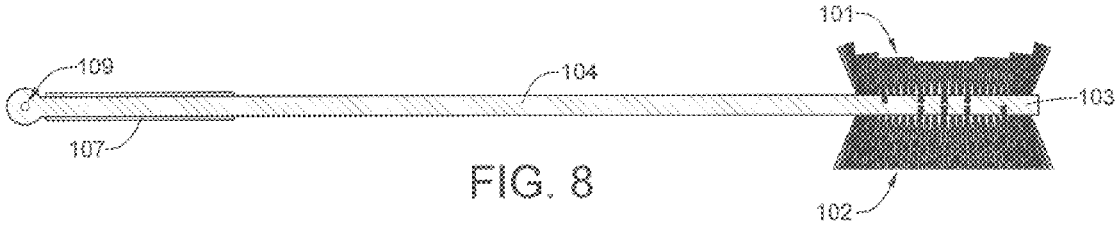
FIG. 8 is a cross-sectional view of the back-to-back brush of FIG. 3, taken through line 5—5 thereof, showing a second embodiment bristle configuration for the concave brush head.

Referring now to FIG. 8, a second embodiment of the bristle configuration for the concave head 101 is shown. Though somewhat difficult to represent in a drawing of this type, the idea is clearly shown. Instead of having a smooth concave, or dish, shape to the face of the head 101, the bristles of each bristle bundle farther from the central bristle bundle are successively longer. This imparts a step function to the appearance. Though not necessarily the preferred configuration, it may be easier to manufacture the concave brush head 101 with pre-cut bristles rather than to trim the bristles once they are imbedded within the body 103.

Although only several embodiments of the invention have been heretofore described, it will be obvious to those having ordinary skill in the art that changes and modifications may be made thereto without departing from the scope and the spirit of the invention.

What is claimed is:

1. A cleaning brush comprising:

an elongate handle;

a generally disk-shaped body rigidly coupled to said handle, said body having back-to-back first and second bristle-mounting surfaces;

a first bristle arrangement having a concave face affixed to said first bristle-mounting surface; and a second bristle arrangement having a planar face affixed to said second bristle-mounting surface, the bristles of said first arrangement being stiffer and of larger diameter than those of said second arrangement.

2. The cleaning brush of claim 1, wherein said body and said handle are injection model as a single unit from a polymeric plastic material.

3. The cleaning brush of claim 2, wherein said unitized body and handle are filleted where they are joined in order to improve mechanical strength at the joint.

4. The cleaning brush of claim 2, wherein structural fibers are embedded within said polymeric plastic material.

5. The cleaning brush of claim 1, wherein said bristles are made of materials selected from the class consisting of nylon, polypropylene, polyester and natural fibers.

6. A cleaning device comprising:

a handle a brush head rigidly coupled to said handle, said head having first and second back-to-back bristle mounting surfaces;

a first bristle arrangement affixed to said first bristle mounting surface, said first bristle arrangement having a concave face; and a second bristle arrangement affixed to said second bristle mounting surface, said first bristle arrangement having a planar face, the bristles of each arrangement being of uniform polymeric material composition.

7. The cleaning device of claim 6, wherein said handle is elongate.

8. The cleaning device of claim 6, wherein the bristles of said first arrangement are stiffer and of larger diameter than those of said second arrangement.

9. The cleaning device of claim 6, wherein said body and said handle are injection molded as a single unit from a-polymeric plastic material.

10. The cleaning device of claim 9, wherein structural fibers are embedded within said polymeric plastic material.

11. The cleaning device of claim 6, wherein said bristles are made of materials selected from the class of synthetic polymeric materials consisting of nylon, polypropylene, polyester fibers.

12. The cleaning device of claim 6, wherein said body is generally disk-shaped, and said first and second bristle arrangements, when from a plan perspective, have generally circular configurations.

13. The cleaning device of claim 12 wherein said unitized body and handle are filleted where they are joined in order to improve mechanical strength at the joint.

14. A scrub brush assembly comprising:

a handle a brush head rigidly coupled to said handle, said head having first and second back-to-back bristle mounting surfaces;

a first plurality of bristle bundles, each of which is embedded in said brush head and extends from said first mounting surface, said first plurality of bristle bundles forming a concave brush face;

a second plurality of bristle bundles, each of which is embedded in said brush head and extends from said second mounting surface, said second plurality of bristle bundles forming a planar brush face, the bristles comprising each of said first plurality of bristle bundles being stiffer and of generally larger diameter than those of said second plurality of bristle bundles.

15. The cleaning device of claim 14, wherein the bristles of said first arrangement are stiffer and of larger diameter than those of said second arrangement.

16. The cleaning device of claim 14, wherein said body and said handle are injection molded as a single unit from a polymeric plastic material.

17. The cleaning device of claim 14, wherein said body is generally disk-shaped, and said first and second bristle faces when viewed from a plan perspective, have generally circular configurations.

* * * * *